US007866992B2

(12) United States Patent
Pfeiffer

(10) Patent No.: US 7,866,992 B2
(45) Date of Patent: Jan. 11, 2011

(54) CONNECTION SYSTEM, IN PARTICULAR ELECTRICAL CONNECTION SYSTEM

(75) Inventor: Klaus Pfeiffer, Heidenheim (DE)

(73) Assignee: MagCode AG, Nattheim (DE)

( * ) Notice: Subject to any disclaimer, the term of this patent is extended or adjusted under 35 U.S.C. 154(b) by 115 days.

(21) Appl. No.: 11/816,973

(22) PCT Filed: Feb. 21, 2006

(86) PCT No.: PCT/EP2006/001560

§ 371 (c)(1),
(2), (4) Date: Sep. 17, 2008

(87) PCT Pub. No.: WO2006/089715

PCT Pub. Date: Aug. 31, 2006

(65) Prior Publication Data

US 2009/0023315 A1 Jan. 22, 2009

(30) Foreign Application Priority Data

Feb. 23, 2005 (DE) ..... 20 2005 002 921 U

(51) Int. Cl.
*H01R 13/44* (2006.01)

(52) U.S. Cl. ..... 439/140; 439/332

(58) Field of Classification Search ..... 439/140, 439/332, 137

See application file for complete search history.

(56) References Cited

U.S. PATENT DOCUMENTS

| | | | | |
|---|---|---|---|---|
| 2,102,625 | A * | 12/1937 | Hubbell, Jr. | 439/140 |
| 3,233,203 | A * | 2/1966 | Kennedy et al. | 439/140 |
| 3,339,171 | A * | 8/1967 | Carlson | 439/140 |
| 5,823,806 | A * | 10/1998 | Nagase et al. | 439/140 |
| 6,309,231 | B1 * | 10/2001 | Gordon et al. | 439/140 |
| 7,322,859 | B2 * | 1/2008 | Evans | 439/671 |

FOREIGN PATENT DOCUMENTS

| | | |
|---|---|---|
| DE | 42 08 479 A1 | 9/1993 |
| FR | 2 339 948 A | 8/1977 |
| GB | 866 308 A | 4/1961 |

* cited by examiner

*Primary Examiner*—Gary F. Paumen
(74) *Attorney, Agent, or Firm*—GrayRobinson, P.A.

(57) ABSTRACT

A connection system, in particular an electrical connection system, having a male connector and having a female connector has a bayonet-type connection for connecting the male connector and the female connector. The bayonet-type connection has at least one axially extending insertion channel and at least one adjoining latching position, which is offset in the circumferential direction with respect thereto, in the female connector, the end side of the female connector, which end side is provided for connection to the male connector, being covered by a cover, which is arranged adjustably in the female connector such that, when the male connector is positioned on it, the opening is released by this male connector in order to produce the connection.

2 Claims, 6 Drawing Sheets

CONNECTION SYSTEM, IN PARTICULAR ELECTRICAL CONNECTION SYSTEM

CROSS-REFERENCE TO RELATED APPLICATION

This application is a U.S. National Phase Entry Under 35U.S.C. §371 of, and claims priority under 35 U.S.C. §§119, 120, 363 and 365 to PCT/EP2006/001560, filed Feb. 21, 2006 which designated the United States and at least one other country other than the United States and which claims priority to German Patent Application No. 20 2005 002 921.1, filed Feb. 23, 2005.

BACKGROUND OF THE INVENTION

The invention relates to a connection system, in particular an electrical connection system, having a plug and having a socket, a bayonet-type connection being provided for connecting the plug and socket.

Bayonet-type connections for a secure connection between a plug and a socket are generally known.

In vehicle construction, in particular in motor vehicle construction, mechanical, and above all, also electrical connection systems are increasingly required also in the luggage area, for example in the trunk, in the region of the rear seats and loading area. The known electrical connection systems are inconvenient owing to their design or represent disruptive elements. This applies in particular to the trunk, where if possible no protruding parts are desired. When the known electrical connection systems are not in use, in the prior art the socket is covered by a separate covering element if the connection does not remain completely open. The latter case is particularly prevalent if the covering element is lost.

SUMMARY OF THE INVENTION

The present invention is therefore based on the object of providing a connection system of the type mentioned at the outset which has a relatively small physical depth and does not become disruptive either in the installed state or when not in use.

This object is achieved according to the invention by virtue of the fact that the bayonet-type connection in the socket has at least one axially running insertion channel and at least one adjoining locking position which is offset in the circumferential direction with respect thereto, the front side of the socket which is provided for connection to the plug being covered by a cover, which is arranged in the socket displaceably such that, when the plug is positioned, the opening is released by said plug for the purpose of producing the connection.

Owing to the fact that the bayonet is designed to have the axial insertion channel and the locking position, which is offset with respect thereto in the circumferential direction, for example a locking channel running in the circumferential direction, firstly a secure connection is provided and secondly, however, only a relatively low physical depth is required. Owing to the arrangement according to the invention of the cover, the socket, when not in use, can be integrated so as not to be disruptive in the area surrounding the socket or can be adapted so as to correspond to said socket. It is thus possible, for example, for it to be installed in a vehicle wall or a loading floor. At the same time, a contamination-proof cover for the electrical contacts is provided, with the result that their functioning is also not impaired in the event of use for a relatively long period of time.

In this case, the socket can be installed into a component surrounding it in such a way that the surface of the socket, together with the cover, is at least approximately flush with the surface of the wall part surrounding the socket. This means that damage to the socket is thus avoided and a loading area is not impaired by protruding parts.

If, in the case of an electrical connection system, the contacts are arranged circumferentially, faultless electrical contact is made, in addition to which, when the electrical connection is led through owing to the rotary movement of the plug in the socket, the contacts are always exposed, as a result of which oxidation is avoided.

The displaceability of the cover and the releasing of the opening of the socket for a connection can take place in a variety of ways. In a simple manner, a spring device may be provided for this purpose which pushes the cover back when the plug is inserted into the bayonet-type connection. Once the plug has been removed, owing to a spring prestress, the cover can if necessary be positioned in front of the free front side again.

In addition to a design as an electrical connection apparatus, the connection system according to the invention can also at the same time be provided for a mechanical connection. It is merely necessary for this purpose for a correspondingly designed connecting element to be provided as the plug, which connecting element is provided, for example, with a hook or an eye in order to be able to suspend the tensioning cable, for example. Likewise, such a fastening element can also be used as a suspension device.

BRIEF DESCRIPTION OF THE DRAWINGS

Advantageous developments and configurations can be gleaned from the remaining dependent claims and from the exemplary embodiments described in principle below with reference to the drawing, in which:

DETAILED DESCRIPTION

Figure 3:
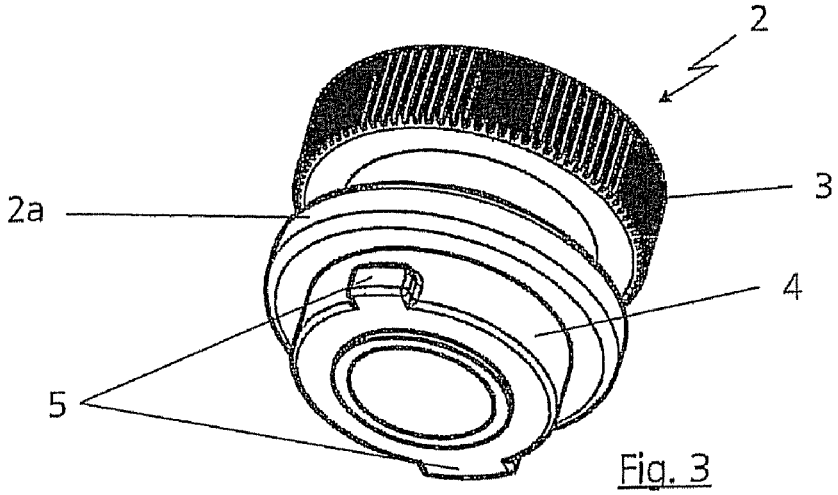
FIG. 3 shows a perspective illustration of a plug as a mechanical fastening element.
Figure 4:
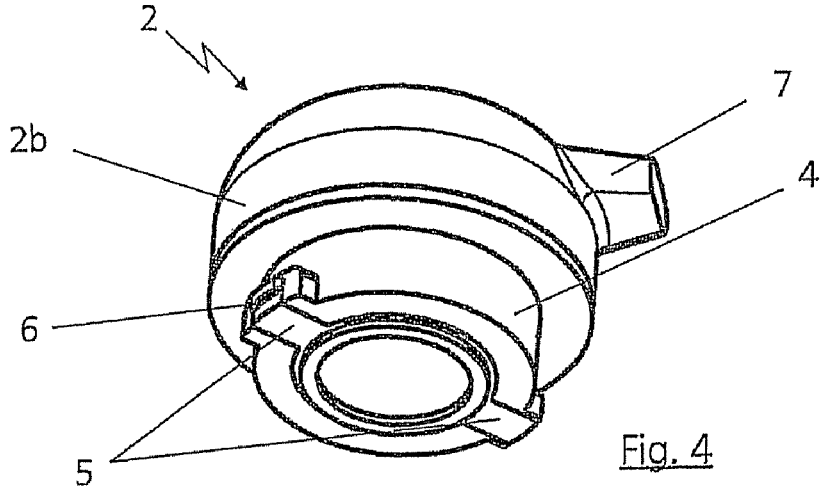
FIG. 4 shows a perspective illustration of an electrical plug.
Figure 5:
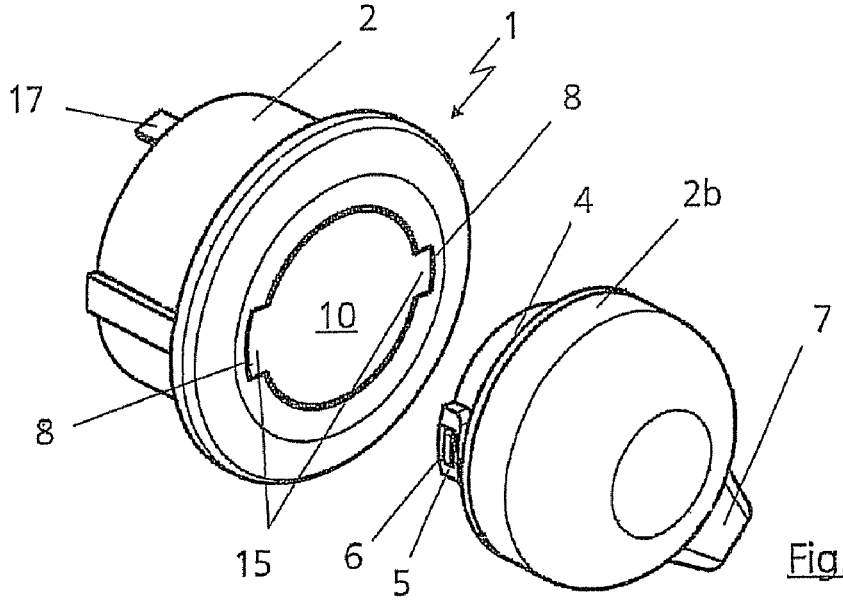
FIG. 5 shows a perspective illustration of a socket having an electrical plug.

The connection system has a socket 1 and a plug 2, which may be in the form of a mechanical fastening element 2*a* or in the form of an electrical plug 2*b*. As can be seen from FIG. 3, the mechanical plug 2*a* has a knurled disk 3 on its side remote from the connection side. In addition, the knurled disk 3 can be provided with a fastening element in the form of an eye or a hook (not illustrated). The essential feature of the two types of plug is the design for a bayonet-type connection with the socket 1. For this purpose, the plug 2 has a round part 4 in its front part, from which round part two cams or lugs 5 lying opposite one another protrude circumferentially. In the case of the electrical plug 2*b*, contact elements 6 are arranged on the outside or over the circumference of the two lugs 5, which contact elements lead, in the interior of the plug, to a connection branch 7 of the plug 2*b* in a manner not illustrated in any more detail, from where, correspondingly, cables (not illustrated) lead to an electrical load.

Figure 7:
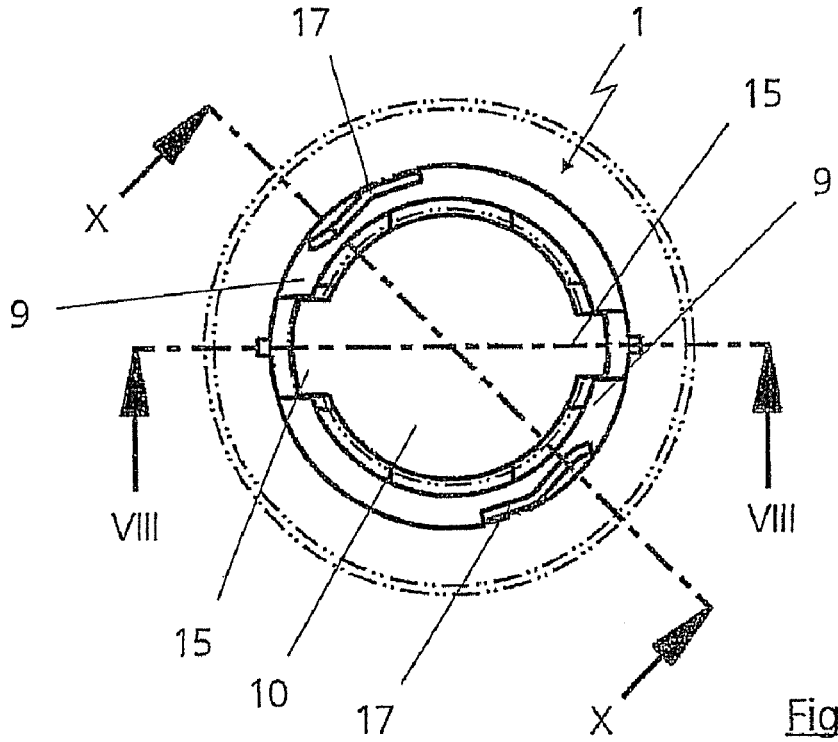
FIG. 7 shows a cross section through the socket shown in FIG. 1.

In order to implement a bayonet-type connection, the socket has, in its circumferential wall 20, two insertion channels 8 lying opposite one another which run in axial direction and are matched in terms of their width and depth to the protruding lugs 5 of the plug. Locking channels 9 running in the circumferential direction in the circumferential wall 20 for a locking position adjoin the two axial insertion channels 8 (see FIGS. 7 and 10). The locking channels 9 can run such that an indentation in the form of a latching position results at the end, in which indentation, when the plug 2 is positioned, the lugs 5 are located in the end position in the indentation. In this way, a latching position securing against unintentional detachment is achieved. In order to detach the plug 2, it is then merely necessary to press the plug slightly further in, with the result that it can be withdrawn from the locking channels 9 and the insertion channels 8 again given a corresponding rotary movement in the opposite direction. Such a latching position can also be achieved by a slightly inclined guidance of the locking channels 9 in the form of a rising ramp with an end region which drops off.

Figure 1:
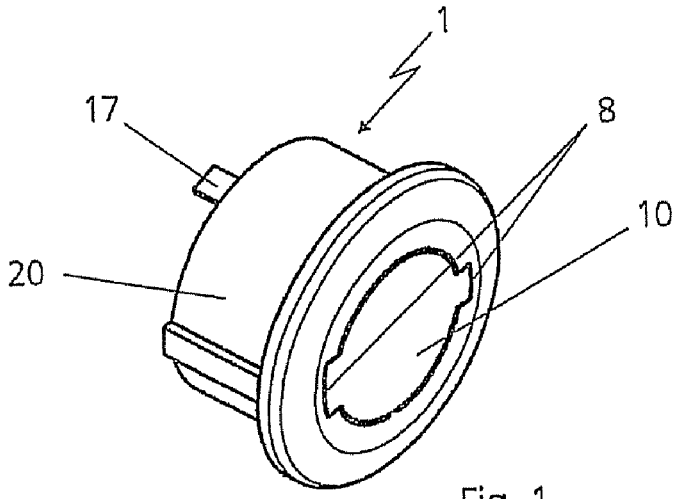
FIG. 1 shows a perspective illustration of the socket according to the invention.
Figure 2:
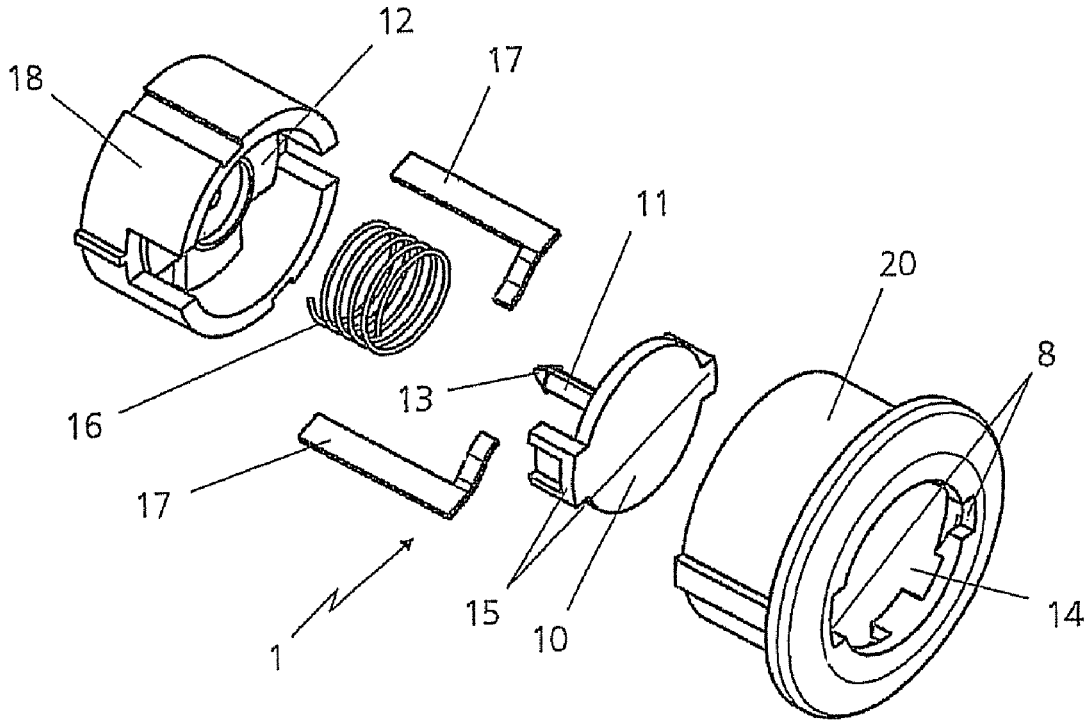
FIG. 2 shows an exploded illustration of the socket shown in FIG. 1.

The design of the socket 1 can be seen in more detail in FIG. 2 in conjunction with FIGS. 7 to 10. The exploded illustration shown in FIG. 2 shows a cover 10 having a pin 11, in which a slot is arranged. The pin 11 can be plugged through a drilled hole in a rear base 12 of the socket 1, an arrow-shaped end 13, which is provided with the slot, of the pin 11 being plugged by being correspondingly compressed through the drilled hole.

By means of the arrow-shaped end 13, which has a larger outer diameter than the shaft of the pin 11, in conjunction with the slot, by means of which the pin 11, when pressed together, can be plugged through the drilled hole, a restraining element for the cover 10 is provided. The cover 10 is matched in terms of its shape to the shape of the open front side 14 of the socket 1 and therefore likewise has lug-like protrusions 15 on opposite sides, which are matched to the cutout 8. As can be seen in particular in FIGS. 1 to 5, the open front side 14 of the socket 1 is therefore covered, the cover 10 terminating flush with the surface of the socket 1. A spring device 16 in the form of a helical spring prestresses the cover 10 favoring the closed position, the arrow-like end 13 forming a stop on the base 12 and preventing the cover 10 from falling out. The spring-like device 16 is supported on the base 12 of the socket 1. Mating contacts 17 are arranged opposite one another in the locking channels 9 in the circumferential wall 20 of the socket 1. Lines (not illustrated) lead out of the mating contacts 17 to a current source. As can be seen in the exploded illustration shown in FIG. 2, for installation reasons the housing of the socket 1 is in two parts, namely comprising the circumferential wall 20 and a rear, likewise round socket part 18, which is inserted into the interior of the circumferential wall 20 and also has the base 12.

Figure 8:
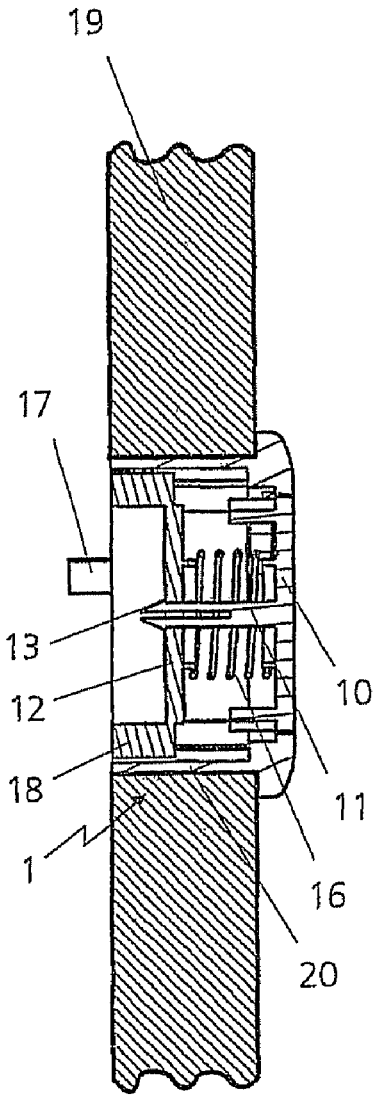
FIG. 8 shows a section along the line VIII-VIII in FIG. 7.
Figure 9:
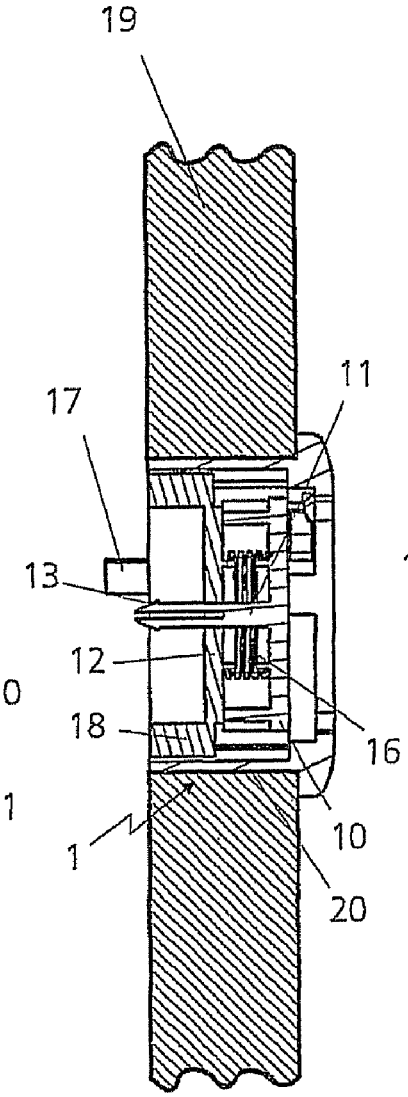
FIG. 9 shows a section corresponding to the section shown in FIG. 8 with a partially inserted cover.
Figure 10:
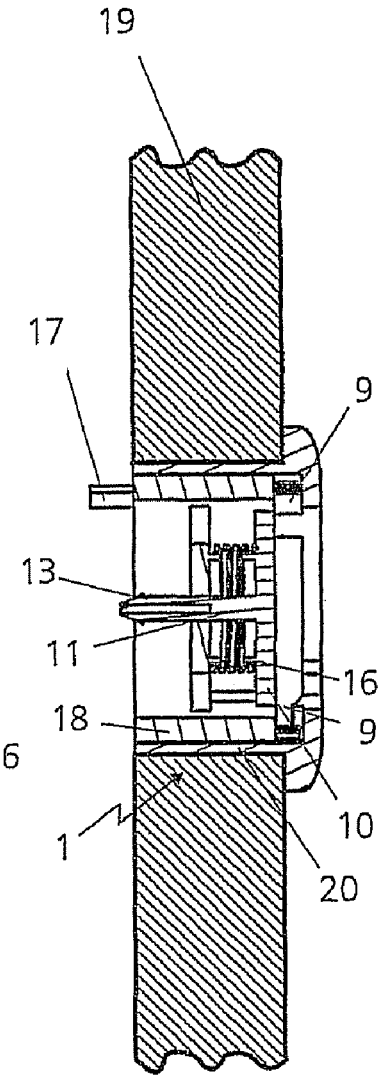
FIG. 10 shows a section along the line X-X shown in FIG. 7.

As can be seen in particular from FIGS. 8, 9 and 10, the socket 1 has a relatively small physical depth and can be inserted completely or virtually completely into a wall 19 surrounding the socket.

As can be seen, the connection system with the socket 1 and the plug 2, depending on the type of plug, can be used both as a mechanical fastening device and as an electrical connection device. The socket 1 accommodates both types of plugs 2*a* and 2*b*. In the case of a mechanical connection device with the plug 2*a*, there is simply no electrical contact connection with the mating contacts 17.

FIG. 8 shows the socket 1 with the cover 10, in which said cover is flush with the front side of the socket 1.

FIGS. 9 and 10 show the position of the cover 10 if the plug 2 (not illustrated here) is positioned on the socket 1.

In place of a cable connection of the plug via the connection branch 7, an electrical load can also be positioned directly on the electrical plug 2*b*, if desired. This can be seen in FIG. 6. In this case, the plug has a knurled nut 21 on its rear side, via which knurled nut a connection to an electrical load 22 (not illustrated in any more detail) takes place. The electrical load 22 (not illustrated in any more detail) may be, for example, a mobile telephone, a charger or else a small display screen.

It is also possible without a great deal of complexity with the connection system according to the invention to make more than only two electrical contact connections. There are two possibilities for this, namely a plurality of contact elements 6 and mating contact elements 17 arranged one behind the other in the axial direction in the plug 2*b* and in the socket 1 or else a plurality of contact elements 6 and mating contact elements 17 arranged distributed over the circumference in the plug 2*b* and in the socket 1.

In an axial arrangement, the lugs 5 need to be extended correspondingly in the axial direction or correspondingly a plurality of rows of lugs need to be arranged one behind the other in the round part 4 (not illustrated). In this case, a plurality of locking channels 9 located at different axial heights need to be provided correspondingly also in the socket 1.

In an arrangement in the circumferential direction, the locking channels 9 need to be extended correspondingly in the circumferential direction and likewise need to be provided correspondingly with further mating contact elements 17. In this case, correspondingly a plurality of lugs 5 need to be arranged at the same axial height such that they are offset with respect to one another correspondingly in the circumferential direction (not illustrated).

FIGS. 11 to 14 illustrate an exemplary alternative embodiment of the connection system according to the invention having a plug 2' having a different configuration.

In the description below, the same reference symbols have been used for identical or functionally identical parts as in the exemplary embodiment described above.

Figure 11:
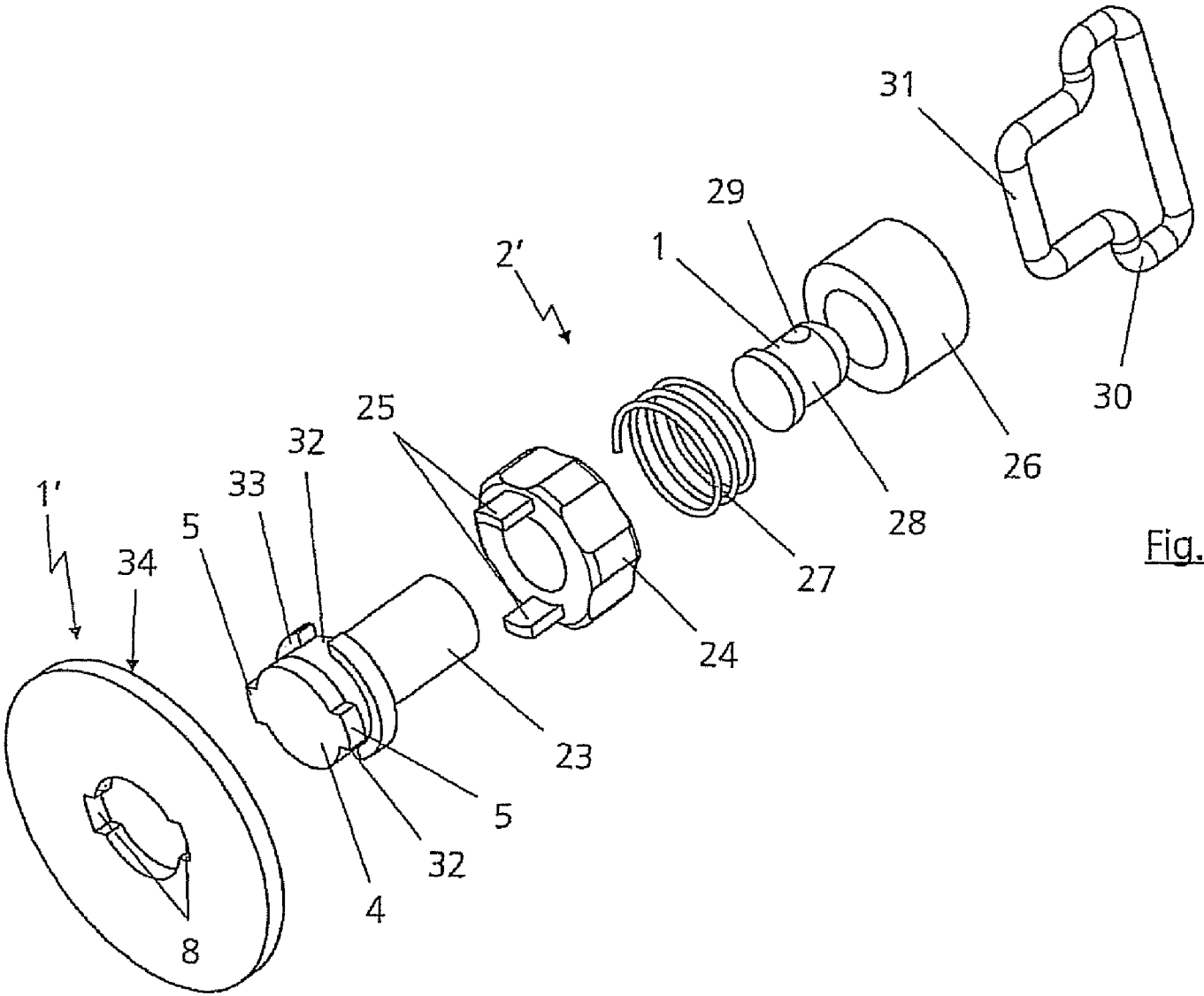
FIG. 11 shows a perspective, exploded illustration of a plug in another configuration.

As shown in FIG. 11, the plug 2' has a cam carrier 23, at whose front end facing the socket 1' the round part 4 is provided with the two cams or lugs 5 lying opposite one another.

On the side of the cam carrier 23 which is remote from the socket 1', a locking part in the form of a locking ring 24 is located which is pushed onto a cylindrical part of the cam carrier 23. Two locking cams 25, which protrude axially out of the locking ring 24, are located opposite one another on the front wall region, which faces the socket 1', of the locking ring 24. As is shown, the two locking cams 25 are offset in the circumferential direction with respect to the cams or lugs 5 by 90°. A grip part in the form of a grip ring 26 is located on the side remote from the socket 1'. A spring device in the form of a helical spring 27 is arranged between the grip ring 26 and the locking ring 24.

The grip ring 26 has an inner drilled hole, into which a rotary part 28 with a transverse drilled hole 29 is inserted, the rotary part 28 being capable of being rotated with respect to the grip ring 26. A fastening element, for example a retaining eye 30, is provided with a transverse part 31, which is guided through the transverse drilled hole 29. The retaining eye 30 serves the purpose of fastening parts which are intended to be secured, for example, in the trunk of a vehicle. Owing to the fact that the rotary part 28 is capable of rotating, in this case the retaining eye 30 can be positioned in any desired rotary position.

While the grip ring 26 is rigidly connected to the cam carrier 23, the locking ring 24 is capable of being displaced in the axial direction with respect to the cam carrier 23. Owing to the locking cams 25, which protrude into cutouts 32 of a circumferential ring 33 of the cam carrier 23, however, the cam carrier 23 and the locking ring 24 are prevented from rotating or are caused to rotate jointly.

Figure 12:
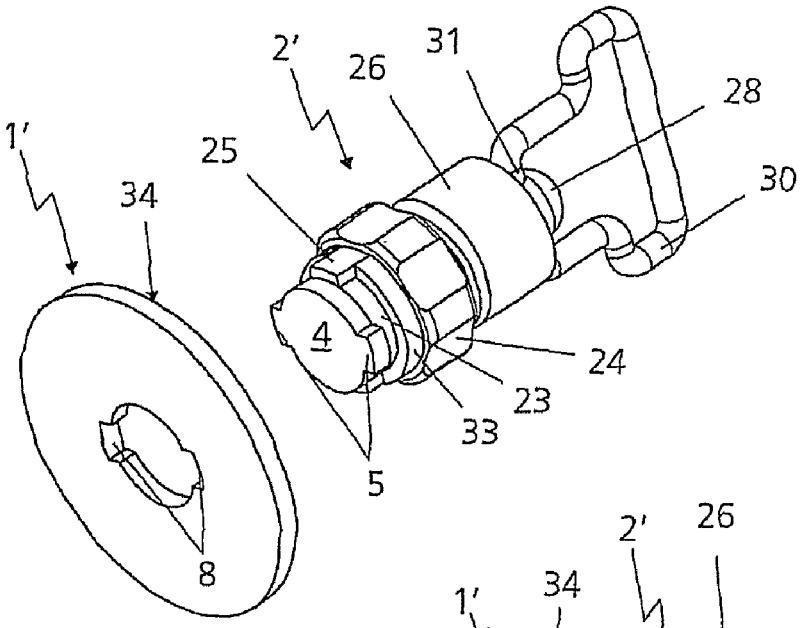
FIG. 12 shows a perspective illustration of the plug shown in FIG. 11 in the assembled state prior to it being inserted into a socket or into a profiled drilled hole of a wall.

The way in which the connection system with the plug 2' shown in FIG. 11 functions will become apparent below using descriptions relating to FIGS. 12 to 14.

In the first step, the plug 2' is brought close to the socket 1' such that the insertion channels 8 are aligned with the lugs 5. Owing to the prestress by means of the helical spring 27 tensioned between the grip part 26 and the locking ring 24, the locking ring bears against the circumferential ring 33 of the cam carrier 23, the locking cams 25 protruding in the direction of the socket 1' forwards through the cutouts 32 over the circumferential ring 33.

Figure 13:
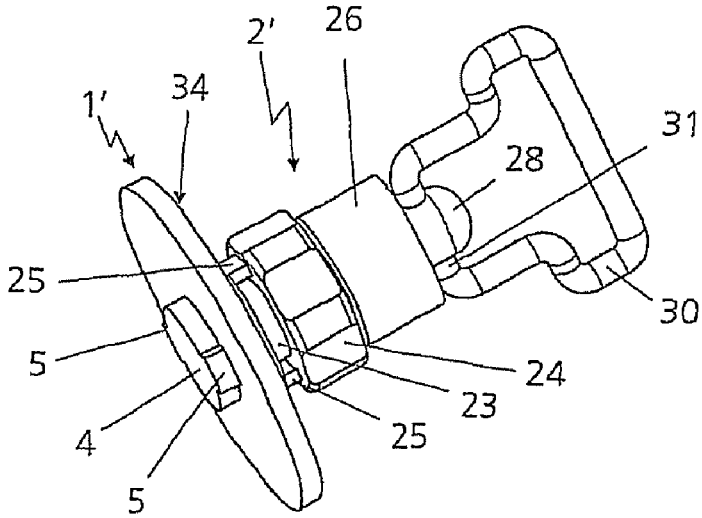
FIG. 13 shows a perspective illustration of the plug inserted into the socket.
Figure 14:
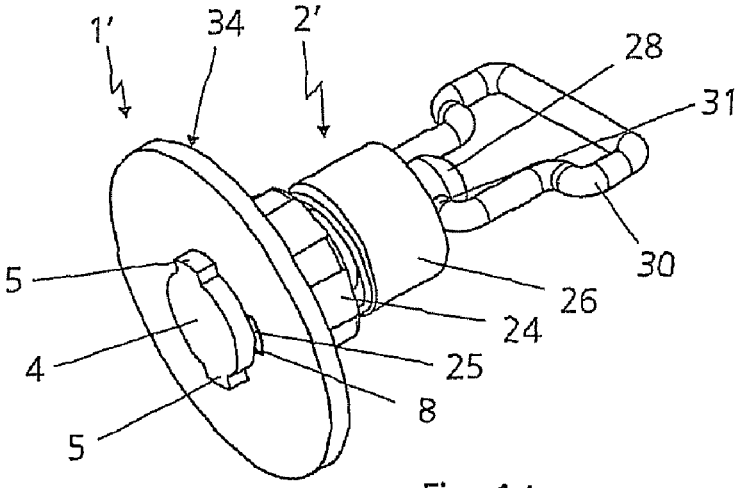
FIG. 14 shows a perspective illustration of the plug inserted into the socket, in a locking position.

FIG. 13 shows the position of the plug 2' in which the cams 5 have been pushed through the insertion channels 8 of the socket 1'. While the lugs 5 are being pushed through the insertion channels 8, the locking cams 25 abut a wall 34 of the socket 1' with their front side, which wall 34 faces the plug 2'. On overcoming the prestress owing to the spring 27, the locking ring 24 is pushed back during the insertion movement of the lugs 5 into the insertion channels 8. As soon as the lugs 5 are located on the rear side of the wall part 34 and therefore the lugs 5 can be rotated in the circumferential direction, the grip ring 26 and therefore also the cam carrier 23, which is rigidly connected to it, can be rotated in the circumferential direction through a desired angle. The angle of the rotary movement depends on the positioning of the locking cams 25 in relation to the lugs 5. Since the angular difference is 90° in this case, a corresponding rotary movement by the operator through 90° takes place on the grip ring 26. Once this rotary movement has ended, the locking cams 25 are therefore in front of the insertion channels 8 and, since they correspond to the channel shapes of the insertion channels 8 in terms of shape and configuration, the locking cams 25 are pressed into the insertion channels 8 by means of the spring 26 which is being relieved of tension, whereby locking and, at the same time, protection against rotation is provided (see FIG. 14). The cams 5, which, as can be seen in FIG. 14, are arranged such that they are offset through 90° with respect to the insertion channels 8, ensure that the plug 2' cannot be withdrawn from the socket 1 in the axial direction.

In order to release the plug 2' from the socket 1', it is merely necessary to manually pull back the locking ring 24 against the force of the spring 27 from the socket 1' until the locking cams 25 are released from the insertion channels 8. Then, with a back-rotation through 90°, the lugs 5 are again brought in front of the insertion channels 8, and the plug 2' can be withdrawn.

The rotary movement in the form of 90° is naturally only mentioned by way of example. In practice, other values are also possible here.

The advantage of the exemplary embodiment with the plug 2' in comparison with the plug 2 described initially consists, inter alia, in that the socket 1' can have a substantially simpler design. In practice, only one wall 34 is required as the "socket", which wall is provided with a profiled drilled hole which has cutouts in the form of the insertion channels 8. This means that, if there is a sufficient wall thickness, for example of at least 1 to 2 millimeters, the connection system according to the invention can be introduced in a simple manner at any desired point in available walls, for example in walls of a trunk in a vehicle. If there is a sufficient wall thickness for the wall 34 or if this wall is correspondingly reinforced, it is thus possible with the connection system according to the invention also to attach heavy loads or thereby secure heavy loads on the retaining eye 30 of the plug 2'.

Figure 6:
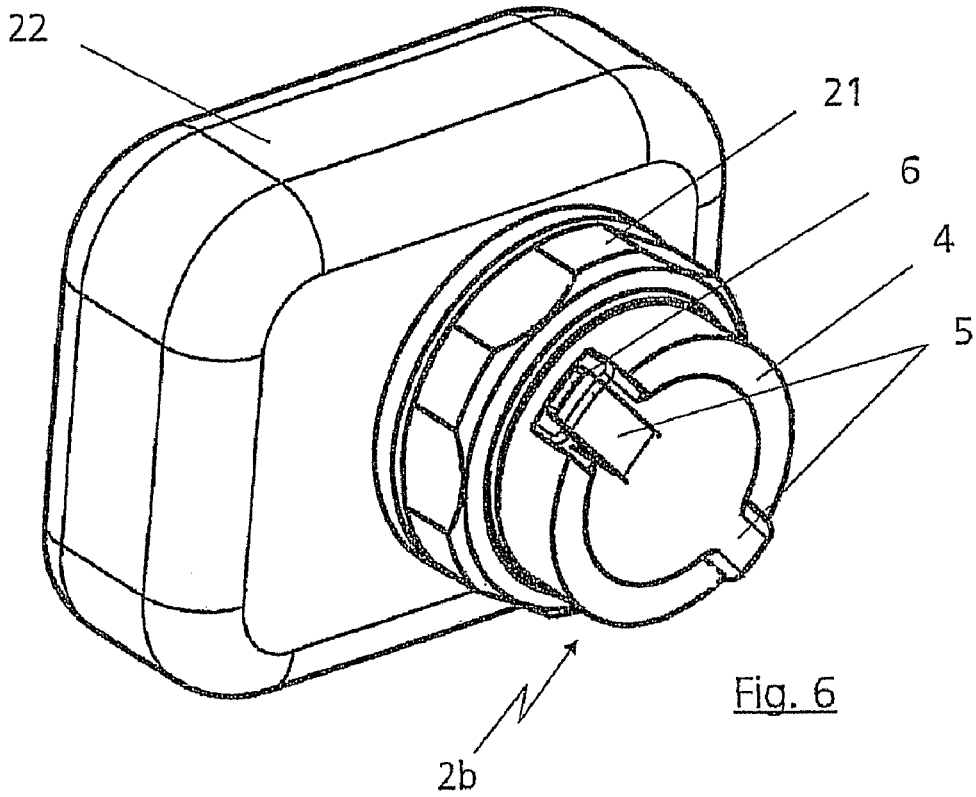
FIG. 6 shows a perspective illustration of an electrical plug having a connecting element for an electrical load.

A further advantage in comparison with the exemplary embodiment shown in FIGS. 1 to 10 also consists in the fact that, as a result of the ability of the rotary part 28 to rotate in relation to the grip ring 26, the retaining eye 30, which is connected to the rotary part 28, can remain unchanged in the event of a rotation of the plug 2' during insertion into the socket 1' for the purpose of locking it in its position. This means that it is not rotated as well and parts located on it or else electrical loads provided in place of the retaining eye 30 remain in their original position. In the embodiment shown in FIGS. 1 to 10, the electrical load 22 illustrated in FIG. 6 is rotated along when the bayonet-type connection is produced, which could lead to problems in the event of the need for a positionally correct arrangement of the electrical load 22, the retaining eye 30 or another part which is connected to the retaining eye 30 or to the plug 2' itself.

The cam carrier 23 and the grip ring 26 can be rigidly connected to one another in any desired manner. This can take place, for example, by means of a screw connection or adhesion.

What is claimed is:

1. A connection apparatus, comprising:

a plug having at least one lug, and a socket having a front side mountable substantially flush with a mounting surface, said socket further having:

(a) an interior portion, said interior portion being recessed and adapted for receiving said plug by way of insertion of said plug into said interior portion by way of an opening for making connection between said socket and said plug, said opening communicating with said interior portion and being formed in said socket at a location adjacent said front side of said socket;

(b) at least one insertion channel formed in said socket, said insertion channel extending along an axis defining an axial direction, said axis corresponding to a direction of insertion of said plug into said socket and a direction of removal of said plug from said socket;

(c) at least one locking channel adjoining said insertion channel, said locking channel extending in a circumferential direction and being offset from said insertion channel in said circumferential direction, said circumferential direction being a direction oriented generally transverse to said axial direction; and (d) a displaceable cover for selectively covering said opening when said plug is not received in said interior portion and for clearing said opening when said plug is received within said interior portion, said cover being displaceable within said interior portion and mounted for displacement away from said opening and in said direction of insertion responsive to insertion of said plug into said socket and for displacement toward said opening and in said direction of removal, to a position covering said opening, responsive to removal of said plug from said socket, said plug and said socket being connectable in a locking position by inserting said plug into said interior portion such that said lug passes into said locking channel, said cover being provided with a restraining element which captures said cover to prevent said cover from being expelled from said opening, said restraining element having at least one pin which can be latched in said socket.

2. A connection apparatus, comprising:

a plug having at least one lug, and a socket having a front side mountable substantially flush with a mounting surface, said socket further having:

(a) an interior portion, said interior portion being recessed and adapted for receiving said plug by way of insertion of said plug into said interior portion by way of an opening for making connection between said socket and said plug, said opening communicating with said interior portion and being formed in said socket at a location adjacent said front side of said socket;

(b) at least one insertion channel formed in said socket, said insertion channel extending along an axis defining an axial direction, said axis corresponding to a direction of insertion of said plug into said socket and a direction of removal of said plug from said socket;

(c) at least one locking channel adjoining said insertion channel, said locking channel extending in a circumferential direction and being offset from said insertion channel in said circumferential direction, said circumferential direction being a direction oriented generally transverse to said axial direction; and (d) a displaceable cover for selectively covering said opening when said plug is not received in said interior portion and for clearing said opening when said plug is received within said interior portion, said cover being displaceable within said interior portion and mounted for displacement away from said opening and in said direction of insertion responsive to insertion of said plug into said socket and for displacement toward said opening and in said direction of removal, to a position covering said opening, responsive to removal of said plug from said socket, said plug and said socket being connectable in a locking position by inserting said plug into said interior portion such that said passes into said locking channel, said apparatus further comprising at least one first electrical contact on said socket and at least one second electrical contact on said plug, said first electrical contact and said second electrical contact mating with one another to form an electrical connection when said plug and said socket are connected in said locking position, said plug being provided with a connecting element adapted for direct connection to an electrical load electrically coupleable to said at least one second electrical contact, said connecting element comprising a knurled nut.

* * * * *

UNITED STATES PATENT AND TRADEMARK OFFICE

CERTIFICATE OF CORRECTION

PATENT NO. : 7,866,992 B2
APPLICATION NO. : 11/816973
DATED : January 11, 2011
INVENTOR(S) : Klaus Pfeiffer It is certified that error appears in the above-identified patent and that said Letters Patent is hereby corrected as shown below:

On the title page,
delete "CONNECTION SYSTEM, IN PARTICULAR ELECTRICAL CONNECTION SYSTEM"
and insert --ELECTRICAL CONNECTION APPARATUS--

Column 8, line 20,
delete "that said passes into" and insert --that said lug passes into--

Signed and Sealed this
Thirteenth Day of September, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,866,992 B2
APPLICATION NO. : 11/816973
DATED : January 11, 2011
INVENTOR(S) : Klaus Pfeiffer It is certified that error appears in the above-identified patent and that said Letters Patent is hereby corrected as shown below:

On the title page, Item (54) and at Column 1, lines 1 and 2, title,
delete "CONNECTION SYSTEM, IN PARTICULAR ELECTRICAL CONNECTION SYSTEM"
and insert --ELECTRICAL CONNECTION APPARATUS--

Column 8, line 20,
delete "that said passes into" and insert --that said lug passes into--

This certificate supersedes the Certificate of Correction issued September 13, 2011.

Signed and Sealed this
Eleventh Day of October, 2011

David J. Kappos

David J. Kappos
*Director of the United States Patent and Trademark Office*